US005885653A

United States Patent [19]

Waldenström et al.

[11] Patent Number: 5,885,653

[45] Date of Patent: Mar. 23, 1999

[54] METHOD OF MAKING METAL COMPOSITE MATERIALS

[75] Inventors: Mats Waldenström, Bromma; Stefan Ederyd, Saltsjö-Boo, both of Sweden; Nicolas Chardon, Echirolles; Henri Pastor, Grenoble, both of France

[73] Assignee: Sandvik AB, Sandviken, Sweden

[21] Appl. No.: 781,747

[22] Filed: Jan. 10, 1997

Related U.S. Application Data

[63] Continuation of Ser. No. 589,055, Jan. 19, 1996, abandoned.

[30] Foreign Application Priority Data

Feb. 9, 1995 [SE] Sweden ..... 9500473

[51] Int. Cl.[6] ..... B05D 7/00; B05D 3/02; B22F 1/02

[52] U.S. Cl. ..... 427/217; 427/383.1; 427/383.3; 75/351; 75/362; 419/18; 419/35; 419/64

[58] Field of Search ..... 427/217, 212, 427/215, 226, 383.1; 75/351, 355, 362, 366; 419/18, 35, 64

[56] References Cited

U.S. PATENT DOCUMENTS

| | | | |
|---|---|---|---|
| 3,062,680 | 11/1962 | Meddings | 427/217 |
| 4,981,511 | 1/1991 | Schmidberger et al. . | |
| 5,326,633 | 7/1994 | Clough et al. | 428/288 |
| 5,352,269 | 10/1994 | McClandish et al. | 75/351 |

FOREIGN PATENT DOCUMENTS

| | | |
|---|---|---|
| 378414 | 1/1990 | European Pat. Off. . |
| 346473 | 4/1931 | United Kingdom . |
| 91/07244 | 5/1991 | WIPO . |

*Primary Examiner*—Shrive Beck
*Assistant Examiner*—Bret Chen
*Attorney, Agent, or Firm*—Burns, Doane, Swecker & Mathis, L.L.P.

[57] ABSTRACT

One or more metal salts of at least one of Co, Ni and/or Fe is dissolved/suspended in water. To the solution/suspension is added at least one hard constituent powder to form a slurry. The solvent is evaporated, preferably by spray drying, and the resultant powder is heat treated in a reducing atmosphere. As a result, a coated hard constituent powder is obtained which, after addition of a pressing agent, can be compacted and sintered according to standard practice. In addition to or instead of said salt of Co, Ni and/or Fe, a soluble salt of Mo and/or W can be used.

5 Claims, 2 Drawing Sheets

METHOD OF MAKING METAL COMPOSITE MATERIALS

This application is a continuation of application Ser. No. 08/589,055, filed Jan. 19, 1996.

BACKGROUND OF THE INVENTION

The presently claimed invention relates to a method of producing metal composite materials such as cemented carbide.

Cemented carbide and titanium-based carbonitride alloys (the latter often referred to as cermets) are formed of hard constituents based on carbides, nitrides and/or carbonitrides of Ti, Zr, Hf, V, Nb, Ta, Cr, Mo and/or W in a binder phase essentially based on Co and/or Ni and/or Fe. These alloys are made by powder metallurgical methods comprising milling a powder mixture containing powders forming the hard constituents and binder phase, pressing and sintering.

The milling operation is an intensive milling in mills of different sizes with the aid of milling bodies. The milling time is of the order of several hours up to days. The lengthy milling time is believed to be necessary in order to obtain a uniform distribution of the binder phase in the milled mixture. It is further believed that the intensive milling creates a reactivity of the mixture which further promotes the formation of a dense structure.

GB 346,473 discloses a method of making cemented carbide bodies. Instead of milling, the hard constituent grains are coated with a binder phase metal by an electrolytic method, pressed and sintered to a dense structure. This and other similar methods are, however, not suited for cemented carbide production in a large industrial scale and milling is almost exclusively used within the cemented carbide industry today. However, milling has its disadvantages. During the long milling time, the milling bodies wear and contaminate the milled mixture for which contamination, compensation has to be made. The milling bodies can also break during milling and remain in the structure of the sintered bodies. Furthermore, even after an extended milling, a random rather than an ideal homogeneous mixture may be obtained. In order to ensure an even distribution of the binder phase in the sintered structure, sintering has to be performed at a higher temperature than necessary.

Thus, the properties of the sintered metal composite materials containing two or more components depend to a great extent on how well the starting materials are mixed. An ideal mixture of particles of two or more kinds of materials, especially if one of the components occurs as a minor constituent (which is the case for the binder phase in ordinary metal composite materials), is difficult to obtain. In practice, after extended mixing, a random rather than an ideal homogeneous mixture is obtained.

In order to obtain an ordered mixing of the components in the latter case, the minor component can be introduced as a coating. The coating can be achieved by the use of various chemical techniques. In general, it is required that some type of interaction between the coated component and the coating is present, i.e., adsorption, chemisorption, surface tension or any type of adhesion.

U.S. Pat. No. 5,505,902 discloses a method of applying a coating to hard constituent grains. According to the method of said invention, one or more metal salts of at least one iron group metal containing organic groups are dissolved and complex bound in at least one polar solvent with at least one complex former comprising functional groups in the form of OH or $NR_3$, (R=H or alkyl). The hard constituent powder and a soluble carbon source are added to the solution. The solvent is evaporated and remaining powder is heat treated in inert and/or reducing atmosphere.

U.S. Pat. No. 5,529,804 discloses another method of applying a coating to hard constituent grains. According to the method of that application, hard constituent powders are coated with cobalt and/or nickel metal in solution by reducing the metals from a suitable salt with a polyol while keeping the powder in suspension. The polyol functions both as a solvent and as a reducing agent at the same time and is present in an amount of at least >5 times more moles polyol than moles metal. There is obtained an even distribution of the cobalt and/or nickel over the surface of the hard constituent powder without the formation of islands of pure metal.

OBJECTS AND SUMMARY OF THE INVENTION

It is an object of this invention to avoid or alleviate the problems of the prior art.

It is further an object of this invention to provide a method of producing metal composite materials.

It is an aspect of the invention to provide a method of making a hard constituent powder coated with a metal taken from the group consisting of Co, Ni, Fe, Mo, W and mixtures thereof comprising the following steps:

forming a water solution or suspension of a salt of said metal;

adding to said solution or suspension at least one hard constituent powder to form a slurry;

drying said slurry to obtain a powder; and heat treating said powder in a reducing atmosphere to obtain said at least one hard constituent powder coated with the metal.

DETAILED DESCRIPTION OF THE PREFERRED EMBODIMENTS OF THE INVENTION

Figure 1:
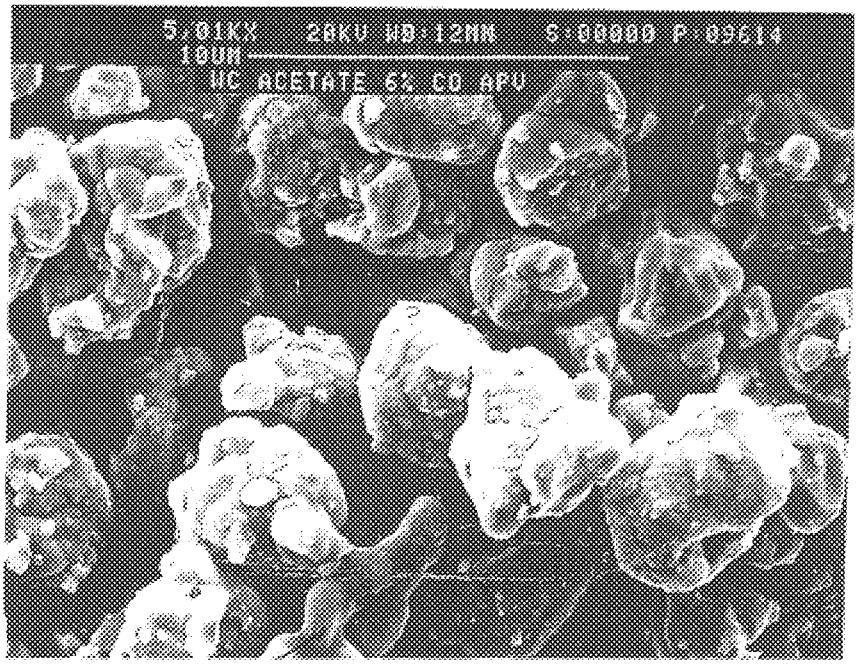
FIG. 1 shows in 5000X WC-powder coated with Co according to the method of the invention.

It has now surprisingly been found that by spray drying a slurry of hard constituent grains in a solution/suspension of Co, Ni, Fe, W and/or Mo-salts, the hard constituent grains can be coated with layers of Co, Ni, Fe, W and/or Mo.

According to the method of the presently claimed invention, one or more metal salts of Co, Ni and/or Fe, preferably their acetates, hydroxides, tungstates and molybdates, are dissolved or suspended in water. At least one hard constituent powder such as WC, (Ti,W)C, (Ta,Nb)C, (Ti,Ta,Nb)C, (Ti,W)(C,N), (Ti,Mo)(C,N), TiC, TaC, NbC, VC and $Cr_3C_2$ is added under vigorous stirring to a slurry. The amounts of said salts and said hard constituent powders are chosen such that the desired final composition is obtained. The slurry is dried in a spray dryer and resultant powder is heat treated in reducing atmosphere, preferably $H_2$.

In an alternative embodiment, a water soluble tungsten and/or molybdenum salt, preferably ammonium metatungstate (AMT) and/or ammoniummolybdate, is dissolved together with said salts of Co, Ni and/or Fe.

In the first alternative, the slurry is dried in a spray dryer followed by heat treatment at 450° C. to 700° C., preferably 500° C. to 550° C., in a reducing atmosphere, preferably $H_2$, for a time sufficient to reduce the salts to the metals, generally for about ½ to 2, preferably for about 1, hours.

In the second alternative, the heat treatment is performed at 700° C. to 1000° C., preferably 750° C. to 900° C., in a reducing atmosphere, preferably $H_2$, for a time sufficient to reduce the salts to the metals, generally for about ½ to 2, preferably for about 1, hours followed by an additional carburization step. That carburization can be either the classical carburization by carbon black or by gas phase carburization at 800° C. to 1250° C., preferably 900° C. to 1000° C., forming an extremely fine-grained WC and/or $Mo_2C$+Co, Ni and/or Fe coating of the hard constituent grains.

In another alternative embodiment, a solution containing only tungsten and/or molybdenum salts is used, resulting in tungsten and/or molybdenum coated hard constituents.

The coated powder is mixed with a conventional pressing agent in ethanol to form a slurry either alone or with other coated hard constituent powders and/or uncoated hard constituent powders and/or binder phase metals and/or carbon to obtain the desired composition. The slurry then is dried, compacted and sintered in the usual way to obtain a sintered body of hard constituents in a binder phase.

The invention is additionally illustrated in connection with the following Examples which are to be considered as illustrative of the present invention. It should be understood, however, that the invention is not limited to the specific details of the Examples.

EXAMPLE 1

A WC-6% Co cemented carbide was made in the following way according to the presently claimed invention: 1000 g of WC ($d_{FSSS}$=4.1 $\mu$m) was introduced to 896.2 ml of an aqueous solution of cobalt acetate (71.3 g Co/l). The suspension was vigorously stirred in order to keep a homogeneous distribution of the WC particles in the suspension. The suspension was spray dried in a classical way and particles of WC coated by cobalt acetate were obtained.

The reduction step was then performed in a push furnace at 520° C. for 1 hour. A WC—Co powder was obtained which was made of partially coated WC particles plus some free cobalt particles (FIG. 1). EDX spot analysis on apparently non-coated WC surfaces showed the presence of cobalt indicating that all WC particles were coated by a thin layer of cobalt.

Figure 2:
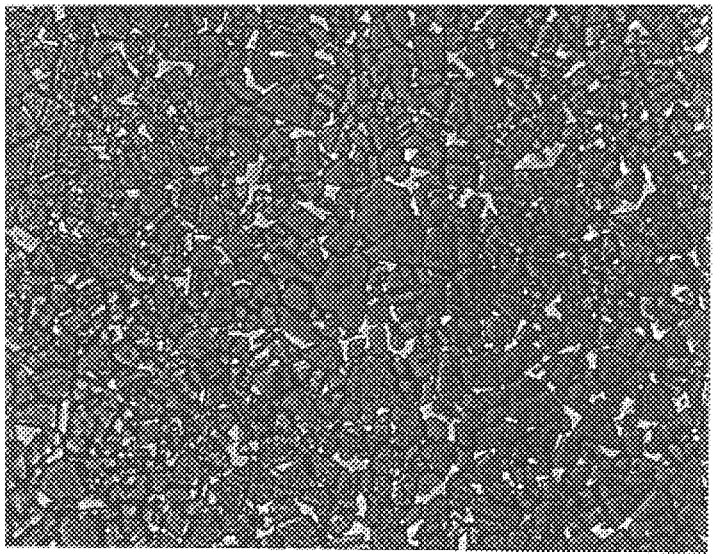
FIGS. 2, 3 and 4 show in 1200X the microstructure of cemented carbide compositions made with the method of the present invention.

The powder obtained was then mixed with pressing agent (2 weight % PEG) in ethanol, dried, compacted and sintered according to standard practice for WC—Co alloys. A dense cemented carbide structure was obtained with porosity A00. FIG. 2 shows the microstructure of a compacted body after sintering at 1450° C.

EXAMPLE 2

A WC—(Ti,W)C(80-20)-7% Co cemented carbide was made in the following way according to the presently claimed invention: 800 g of WC ($d_{FSSS}$=4.1 $\mu$m) and 200 g (Ti,W)C ($d_{FSSS}$=4.9 $\mu$m) was introduced in 1056 ml of an aqueous solution of cobalt acetate (71.3 g Co/l). The suspension was vigorously stirred in order to keep a homogeneous distribution of the carbide particles in the suspension. The suspension was spray dried in a classical way and particles of carbide coated by cobalt acetate were obtained.

The reduction step was then performed in a push furnace at 520° C. For 1 hour. A WC—(Ti,W)C—Co powder was obtained which was made of partially coated carbide particles plus some free cobalt particles. EDX spot analysis on apparently non-coated WC and (Ti,W)C surfaces showed the presence of cobalt indicating that all carbide particles were coated by a thin layer of cobalt.

Figure 3:
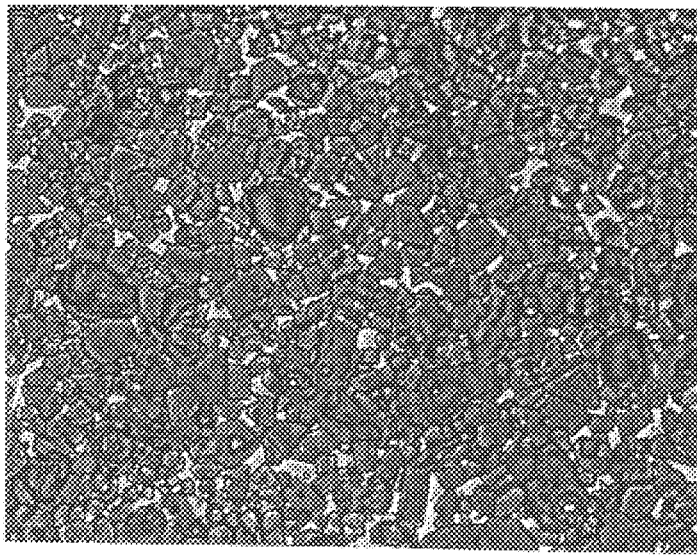

The powder obtained was then mixed with pressing agent (2 weight % PEG) in ethanol, dried, compacted and sintered according to standard practice for WC—(Ti,W)C—Co alloys. A dense cemented carbide structure with good cobalt and gamma phase (cubic phase) distribution was obtained. FIG. 3 shows the microstructure of a compacted body after sintering at 1450° C.

EXAMPLE 3

A WC 85.9-TiC 2.6-TaC 3.6-NbC 2.4-Co 5.5 cemented carbide was made in the following way according to the presently claimed invention.

A solution containing 2395 g of ammonium metatungstate (86% of $WO_3$) previously dissolved in 1.2 l of water was first mixed with 350 ml of an aqueous suspension of cobalt hydroxide containing 110 g of cobalt. Then 52 g of TiC, 72 g of TaC and 48 g of NbC were added to the suspension. The suspension was vigorously stirred in order to keep a homogeneous distribution of the carbide particles added. The suspension was spray dried in a classical way and particles of the suitable compositions were obtained.

The reduction step was then performed in a push furnace at 900° C. for two hours.

The W—TiC—TaC—NbC—Co powder was then mixed with the suitable amount of carbon black and carburized at 1000° C. during 4 hours in a continuous push furnace. A WC—TiC—TaC—NbC—Co powder was obtained.

Figure 4:
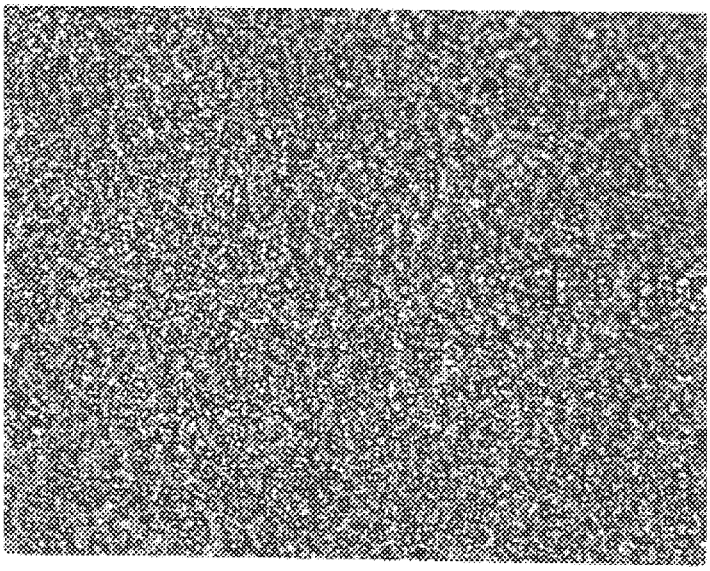

The powder obtained was then mixed with pressing agent (2 weight % PEG) in ethanol, dried, compacted and sintered according to standard practice for WC—(Ti,W)C—Co alloys. A dense cemented carbide structure with good cobalt and gamma phase (cubic phase) distribution was obtained. FIG. 4 shows the microstructure of a compacted body after sintering at 1520° C.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a hard constituent powder coated with a metal selected from the group consisting of Co, Ni, Fe, Mo, W and mixtures thereof comprising the following sequential steps:

forming a water solution or suspension of a salt of said metal;

adding to said solution or suspension at least one hard constituent powder to form a slurry;

drying said slurry to obtain a powder; and heat treating said powder in a reducing atmosphere to obtain said at least one hard constituent powder coated with the metal.

2. The method of claim 1 wherein a soluble tungsten-and/or molybdenum-salt is added to said solution in addition to at least one salt of a metal selected from the group consisting of Co, Ni, Fe and mixtures thereof.

3. The method of claim 2 wherein said powder after said heat treating is further carburized.

4. The method of claim 1 wherein said metal salt is at least one soluble salt of W or Mo.

5. The method of claim 1 wherein said drying is spray drying.

* * * * *